US006520328B2

(12) United States Patent
Ortiz

(10) Patent No.: US 6,520,328 B2
(45) Date of Patent: Feb. 18, 2003

(54) RETAIL RAZOR DISPLAY PACKAGE WITH RAZOR STAND

(75) Inventor: Ernest Ortiz, Beaufort, NC (US)

(73) Assignee: Warner-Lambert Company, Morris Plains, NJ (US)

( * ) Notice: Subject to any disclaimer, the term of this patent is extended or adjusted under 35 U.S.C. 154(b) by 0 days.

(21) Appl. No.: 09/796,130

(22) Filed: Feb. 28, 2001

(65) Prior Publication Data

US 2002/0117411 A1 Aug. 29, 2002

(51) Int. Cl.[7] ..... A45C 11/26
(52) U.S. Cl. ..... 206/352; 206/228; 211/70.6
(58) Field of Search ..... 206/349, 352, 206/461, 477–481, 228; D6/526; 211/60.1, 70.6; 30/541, 32

(56) References Cited

U.S. PATENT DOCUMENTS 3,970,194 A * 7/1976 Iten ..... 206/228
4,140,244 A * 2/1979 Clabby ..... 206/228
5,228,580 A * 7/1993 Grange ..... 211/70.6
D342,853 S * 1/1994 Grange ..... D6/526
5,407,066 A * 4/1995 Grange ..... 206/228
5,429,241 A * 7/1995 Althaus ..... 206/352
5,782,346 A * 7/1998 Gray et al. ..... 206/228
5,966,822 A * 10/1999 Coffin et al. ..... 30/541

* cited by examiner

*Primary Examiner*—Bryon P. Gehman
(74) *Attorney, Agent, or Firm*—Peter C. Richardson; Gregg C. Benson; Raymond D. Thompson

(57) ABSTRACT

Retail razor display packaging comprising a razor stand and a display card. The razor stand is preferably transparent and is designed to engage at least a portion of a display card so that a razor can be positioned on the razor stand and then connected to the display card in a manner which provides an attractive display. The razor stand permits a potential purchaser to view the razor prior to purchasing and then provides a convenient holder for the razor after purchasing and use.

13 Claims, 4 Drawing Sheets

RETAIL RAZOR DISPLAY PACKAGE WITH RAZOR STAND

The present invention is directed to shaving accessories and, more particularly, to a retail razor display package in combination with a razor stand.

BACKGROUND

Razors have been sold in retail outlets with different types of packaging. One type of packaging comprises a display card bearing advertising and other product information. A razor is typically affixed to such a display card with a blister pack, i.e., a molded plastic covering, which interlocks with the display card or which is attached to the display card by some connectors, e.g., staples. Blister packs advantageously hold the product in a desired location on the display card while permitting potential consumers to see the product and read the display card. After purchasing, typically the blister pack and the display card are discarded. While the display card will typically biodegrade, the blister pack requires separate recycling steps if the plastic is to be reused.

Many forms of packaging for razors do not provide protection for the blades when the razor is not in use. This can result in damage and a significantly shortened useful life of a razor head. As used herein, the term "razor head" is meant to include cartridges adapted to be connected to a separate razor as well as the operative cutting portion of a disposable razor wherein the handle and cutting portion are formed as a unit.

It would, therefore, be desirable to provide an aesthetically attractive retail razor package which eliminates the need for a blister pack while retaining the ability for the consumer to view the razor and printed indicia prior to purchasing.

It would also be desirable to provide additional protection for the sharpened blades of a razor head when the razor is not in use in order to maximize the useful life of the razor head.

SUMMARY OF THE INVENTION

Various aspects of the present invention are directed to retail razor display packaging comprising a razor stand and a display card. The razor stand is preferably transparent and is designed to engage at least a portion of a display card so that a razor can be positioned on the razor stand and then connected to the display card in a manner which provides an attractive display. Preferably, the razor stand permits a potential purchaser to view the razor prior to purchasing and then provides a convenient holder for the razor after purchasing and use.

According to one preferred embodiment of the present invention, a display card comprises a foldable portion which is folded over another portion of the display card and a portion of the razor stand. The folded portion is then adhered to the razor stand, for example, with an adhesive. Following purchase, the display card can be readily separated from the razor stand.

According to another aspect of the present invention, the razor stand is provided with a portion which shields the razor head when the razor is not in use.

These and other advantages of the present invention are described below with reference to the figures.

DETAILED DESCRIPTION

Figure 2:
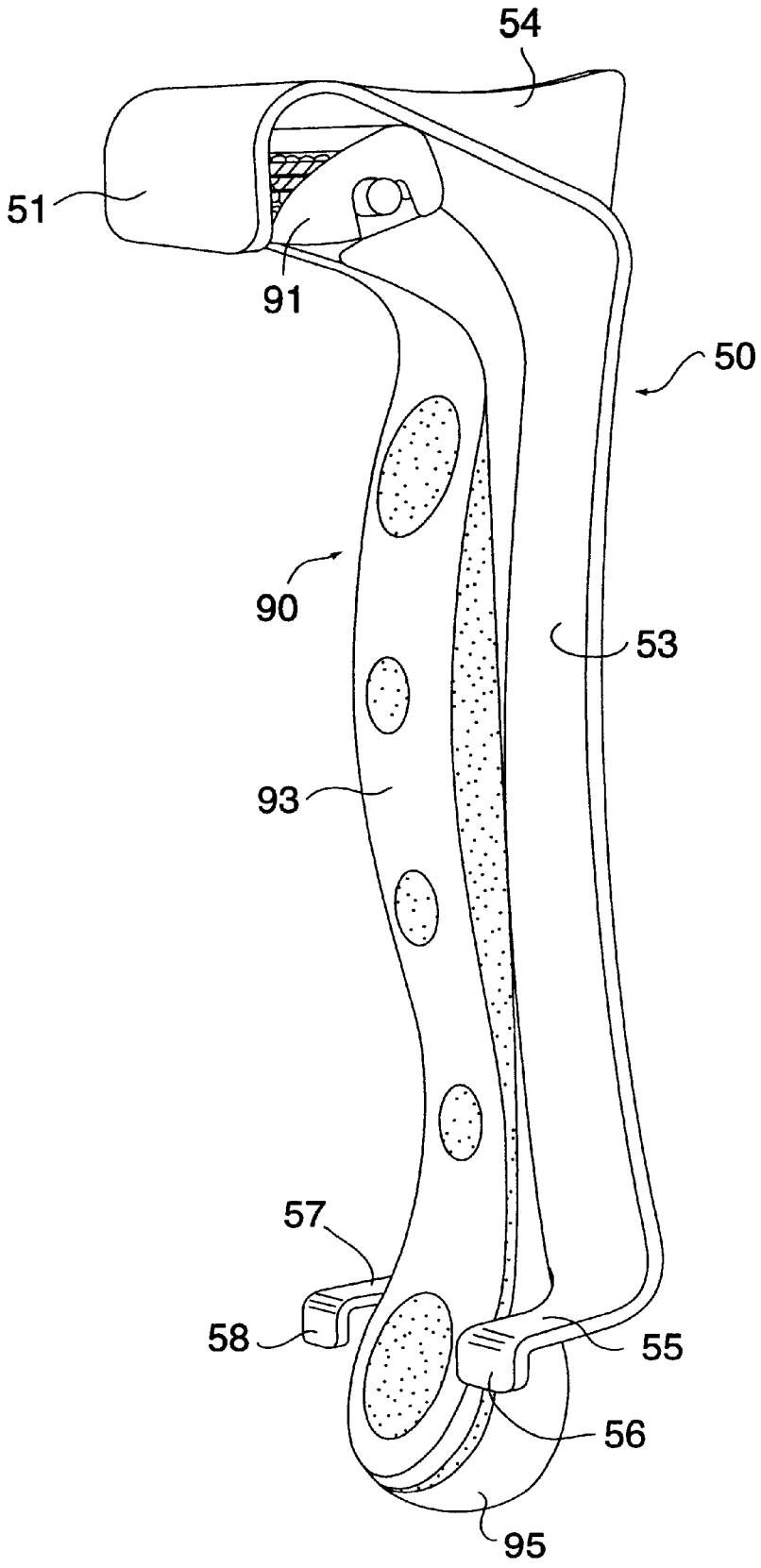
FIG. 2 is a perspective view of the razor and razor stand shown in FIG. 1.

Various aspects of the present invention comprise a retail razor display package in combination with a razor stand. FIGS. 1 through 7 illustrate one preferred embodiment of the present invention comprising a display card 10, a razor stand 50 and a razor 90. As best shown in FIG. 2, the illustrated razor comprises a razor head 91 and an elongated handle 93 terminating in a bulbous end 95 opposite the razor head 91. Suitable high friction materials may be adhered to the razor handle or the handle can be formed with surfaces which enhance gripping when the razor is wet, in a manner known in the art. The particular shape of the razor can vary significantly while still being used with the present invention.

Figure 5:
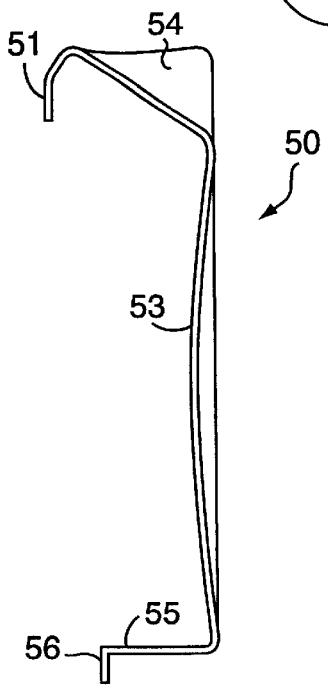
FIG. 5 is a side view of the razor stand.
Figure 6:
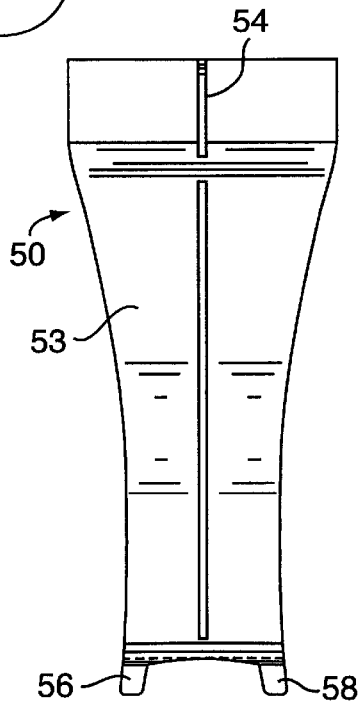
FIG. 6 is a side view of the razor stand.
Figure 7:
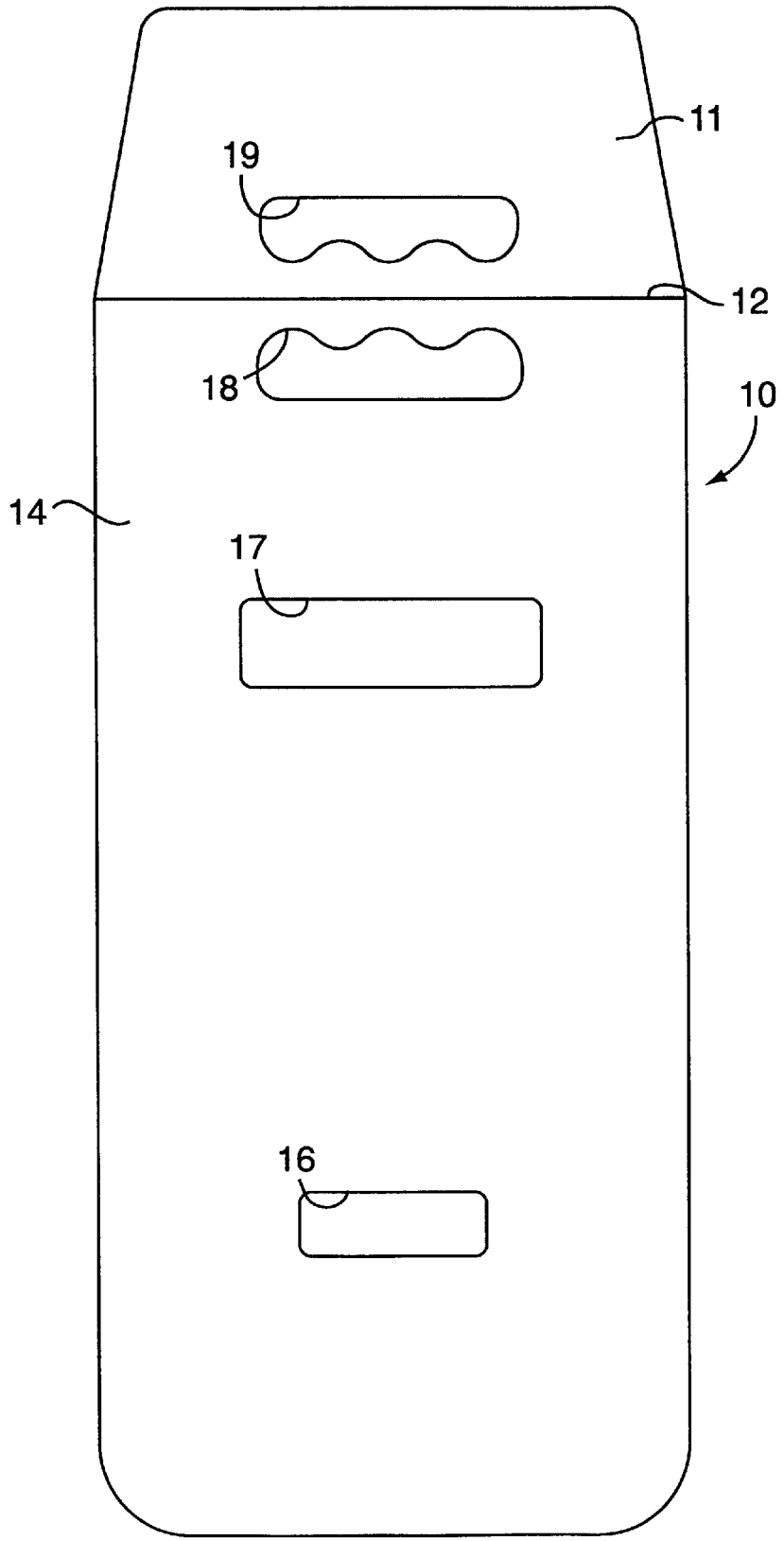
FIG. 7 is a top view of a display card of the present invention.

The illustrated razor stand comprises an elongated portion 53, a support leg 54, a razor head shield 51 and a pair of support arms 55, 57. The support arms 55 and 57 are advantageously spaced in order to receive a portion of the razor handle 93 while supporting the razor 90 in the stand 50. In the illustrated embodiment, the spacing between support arms 55 and 57 is less than the maximum width of the bulbous terminal end 95 of the razor and wider than a narrow portion of the razor handle 93. This spacing of the support arms permits the razor to be positioned between the support arms in a manner which provides vertical support in the illustrated orientation. According to this preferred embodiment of the present invention, razor head 91 is shielded from accidental contact with other objects when the razor is positioned in the stand by shield portion 51 of the stand. From the present description and the drawings, those skilled in the art will appreciate that the shield 51 is designed to enhance the useful life of the razor head by avoiding accidental contact between objects and the sharpened blade edges. FIGS. 5 and 6 are side views and top views of the illustrated razor stand 50. While the razor stands of the present invention can be formed of various materials, it is preferred to form the razor stands using a clear polymeric material, such as a relatively high-impact plastic by injection molding.

In order to facilitate the attachment of razor stand 50 to a display card, the terminal ends of the support arms are provided with lugs. In the illustrated embodiment, lug 56 is integrally formed with support arm 55 while lug 58 in integrally formed with support arm 57.

Figure 1:
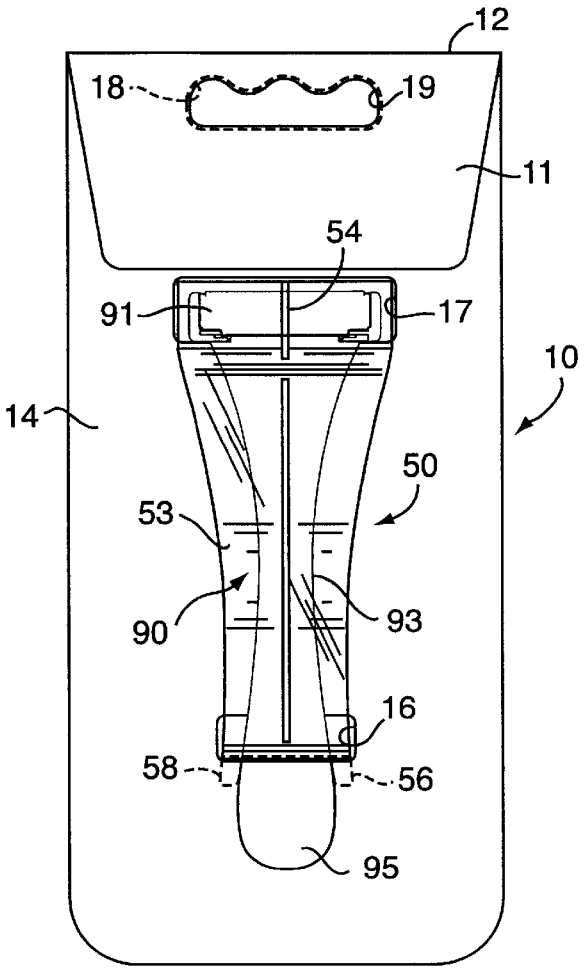
FIG. 1 is a top view of one embodiment of the present invention.
Figure 3:
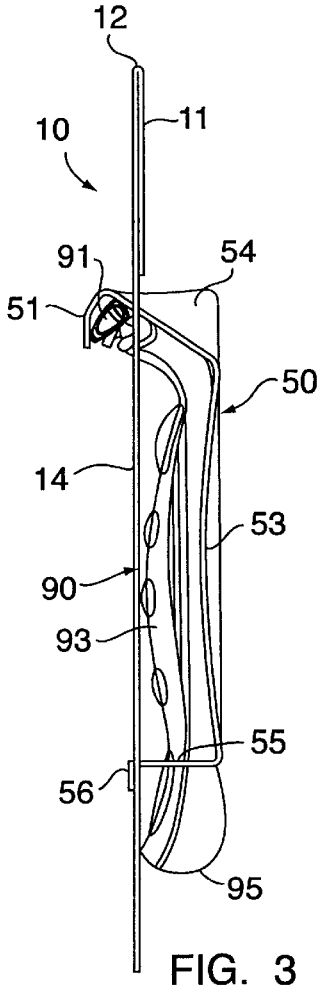
FIG. 3 is a side view of the retail razor display package shown in FIG. 1.
Figure 4:
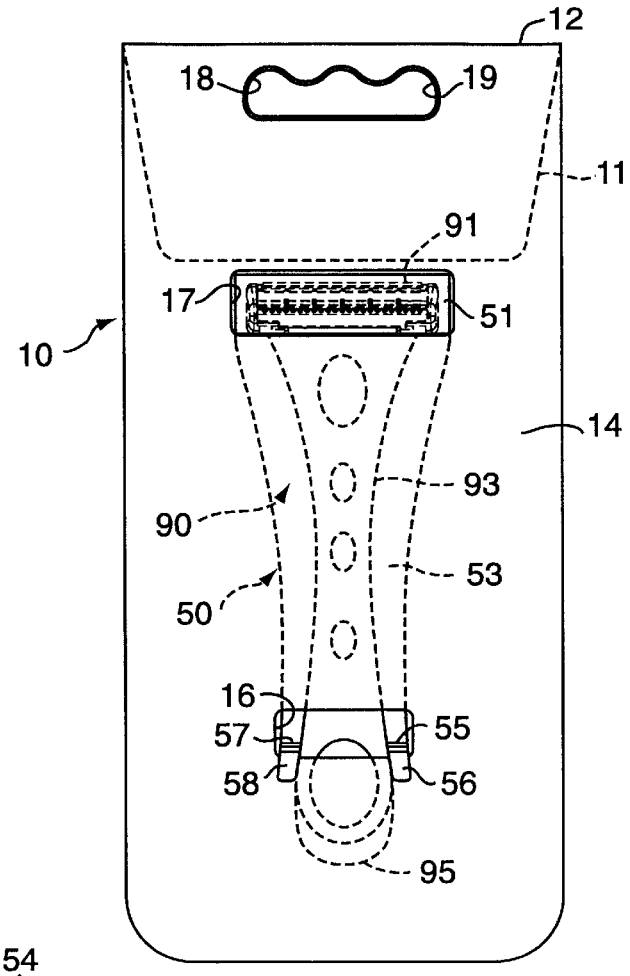
FIG. 4 is a bottom view of the retail razor display package shown in FIG. 1.

The illustrated razor stand 50 is fastened to display card 10 by first inserting lugs 56 and 58 through lower receptacle 16. Shield portion 51 of the stand and razor head 91 are then passed through upper receptacle 17 of display card 10 as best shown in FIGS. 3 and 4. Flap 11 is then folded along fold line 12 to a position overlapping a portion of the body 14 of the display card 10 thereby aligning apertures 18 and 19 to form a single hanging slot in the manner shown in FIGS. 1 and 4. Folding flap 11 is preferably adhered to the back of the razor stand with a removable adhesive.

What is claimed is:

1. A retail razor display package comprising:

a transparent razor stand comprising an elongated portion connecting a first end portion and a second end portion, said first end portion including at least two support arms which extend from said elongated portion and are spaced to receive a handle portion of a razor therebetween, said support arms each including a said at least one engagement lug proximate a terminal end of said support arm;

a display card comprising an aperture which engages said at least one engagement lug, and an overlapping portion; and means for connecting said overlapping portion to said second end portion of said razor stand wherein a razor can be visually displayed on said display card and stored on said stand after use.

2. A retail razor display package according to claim 1 wherein said razor stand comprises a protective cover for shielding blades of the razor when the razor is not in use.

3. A retail razor display package according to claim 1 wherein said stand comprises a transparent polymeric material.

4. A retail razor display package according to claim 1 wherein said display card comprises cardboard.

5. A retail razor display package according to claim 1 wherein said display card comprises at least one aperture for said at least one engagement lug and an aperture for a portion of a razor.

6. A retail razor display package according to claim 1 wherein said connecting means comprises an adhesive.

7. A retail razor display package comprising:

a transparent razor stand comprising means for engaging a razor and at least one engagement lug for engaging a display card, said engaging means comprising an elongated portion, a first end and a second end, said first end including at least two support arms which extend from said elongated portion and are spaced to receive a handle portion of a razor therebetween, said support arms each including at least one engagement lug proximate a terminal end of said support arm; and a display card comprising at least one aperture for engaging said razor stand.

8. A retail razor display package according to claim 7 wherein said at least one aperture of said display card engages said at least one engagement lug.

9. A retail razor display package according to claim 7 wherein said razor stand comprises a protective cover for shielding blades of the razor.

10. A retail razor display package according to claim 7 wherein said razor stand comprises an elongated portion, a first end, and a second end, said first end comprises at least two support arms which extend from said elongated portion and are spaced to receive a handle portion of a razor therebetween, said support arms each comprising a said at least one engagement lug proximate the terminal end of said support arm.

11. A retail razor display package according to claim 7 wherein said stand comprises a transparent polymeric material.

12. A retail razor display package according to claim 7 wherein said display card comprises cardboard.

13. A retail display package according to claim 7 wherein said at least one aperture includes spaced apertures for receiving different portions of said razor stand.

* * * * *